US009260818B2

(12) United States Patent
Shin et al.

(10) Patent No.: US 9,260,818 B2
(45) Date of Patent: Feb. 16, 2016

(54) SINGLE VESSEL REACTOR SYSTEM FOR HYDROLYSIS AND DIGESTION OF WOOD CHIPS WITH CHEMICAL ENHANCED WASH METHOD

(75) Inventors: Namhee Shin, Clifton Park, NY (US); C. Bertil Stromberg, Diamond Point, NY (US); Ventzislav Kirov, Lake Bluff, IL (US); William J. Cann, Carol Stream, IL (US)

(73) Assignee: Andritz Inc., Glens Falls, NY (US)

( * ) Notice: Subject to any disclaimer, the term of this patent is extended or adjusted under 35 U.S.C. 154(b) by 1903 days.

(21) Appl. No.: 12/114,881

(22) Filed: May 5, 2008

(65) Prior Publication Data

US 2008/0295981 A1 Dec. 4, 2008

Related U.S. Application Data

(60) Provisional application No. 60/939,730, filed on May 23, 2007.

(51) Int. Cl.

| | |
|---|---|
| ***D21C 1/02*** | (2006.01) |
| ***D21C 1/04*** | (2006.01) |
| ***D21C 3/02*** | (2006.01) |
| ***D21C 3/26*** | (2006.01) |
| ***D21C 7/00*** | (2006.01) |
| ***D21C 9/02*** | (2006.01) |

(52) U.S. Cl.

CPC .. *D21C 1/02* (2013.01); *D21C 1/04* (2013.01); *D21C 3/02* (2013.01); *D21C 3/26* (2013.01); *D21C 7/00* (2013.01); *D21C 9/02* (2013.01)

(58) Field of Classification Search

CPC ..... D21C 1/02; D21C 1/04

USPC ..... 162/19

See application file for complete search history.

(56) References Cited

U.S. PATENT DOCUMENTS

| | | | | |
|---|---|---|---|---|
| 3,380,883 | A * | 4/1968 | Richter et al. | 162/19 |
| 3,632,469 | A * | 1/1972 | Wilder | 162/25 |
| 4,436,586 | A * | 3/1984 | Elmore | 162/19 |
| 6,686,039 | B2 * | 2/2004 | Sealey et al. | 428/393 |
| 2005/0087314 | A1 * | 4/2005 | Stromberg et al. | 162/19 |

FOREIGN PATENT DOCUMENTS

| | | |
|---|---|---|
| WO | 2007/051269 | 5/2007 |

OTHER PUBLICATIONS

Rydholm, Pulping Processes, 1965, Interscience Publishers, p. 663-671.*

* cited by examiner

*Primary Examiner* — Anthony Calandra
(74) *Attorney, Agent, or Firm* — Nixon & Vanderhye P.C.

(57) ABSTRACT

A reaction vessel including: a material input receiving cellulosic material and a material discharge for the cellulosic material, wherein the cellulosic material flows through the reaction vessel from the material input to the material discharge; a hydrolysate and liquid extraction screen; a hydrolysis zone between the material input and the hydrolysate and liquid extraction screen; a wash zone between the hydrolysate and liquid extraction screen and a wash liquid extraction screen; a wash liquid inlet port for introducing a wash liquid into the wash zone, wherein at least a portion of the wash liquid entering the wash liquid inlet port flows through the wash zone and is extracted by the hydrolysate and liquid extraction screen; a cooking zone between the wash zone and the material discharge and a cooking liquor extraction screen at or below the cooking zone and above the material discharge.

9 Claims, 1 Drawing Sheet

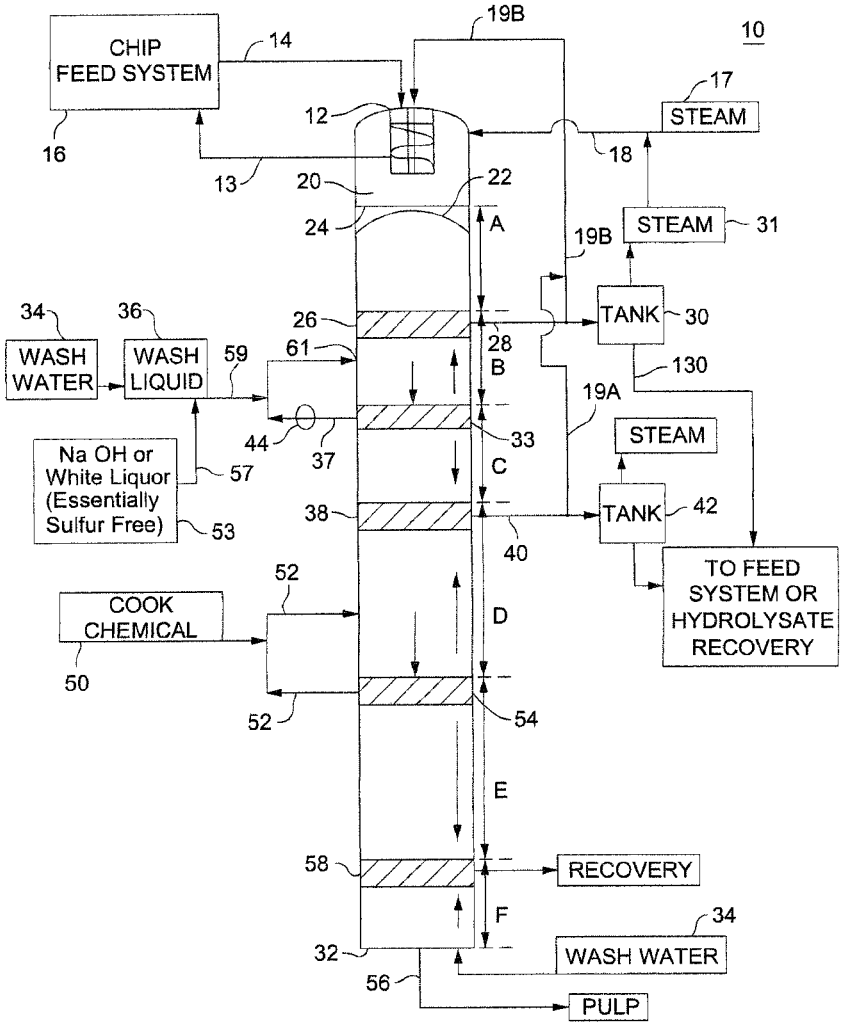
CHIP FEED SYSTEM
14
19B
10
17
STEAM
12
18
16
13
20
22
24
A
STEAM
31
19B
34
36
26
TANK
30
WASH WATER
WASH LIQUID
59
61
28
B
130
19A
44
37
33
STEAM
Na OH or White Liquor (Essentially Sulfur Free)
57
C
38
TANK
42
53
40
TO FEED SYSTEM OR HYDROLYSATE RECOVERY
52
COOK CHEMICAL
D
50
52
54
E
58
RECOVERY
F
34
32
WASH WATER
56
PULP

SINGLE VESSEL REACTOR SYSTEM FOR HYDROLYSIS AND DIGESTION OF WOOD CHIPS WITH CHEMICAL ENHANCED WASH METHOD

RELATED APPLICATION

This application claims the benefit of U.S. Provisional Application Ser. No. 60/939,730, filed May 23, 2007, the entirety of which is incorporated by reference.

BACKGROUND OF THE INVENTION

This invention relates to a method and an apparatus for hydrolysis treatment of cellulosic fiber material.

In conventional systems, wood chips (or other cellulosic or fiber material) can undergo hydrolysis in a single vessel prior to treatment or cooking in a digester, such as described in U.S. Pat. Nos. 3,380,883 and 3,413,189. In such systems, hydrolysis occurs under acidic conditions in the slurry of wood chips, e.g., cellulosic material, passing through a top section of the vessel with the continued treatment of cooking in lower sections of the vessel followed by washing in the bottom of the vessel. In the upper region of the vessel, hydrolysate, e.g., sugars such pentose and hexose, is extracted from wood chips and the hydrolysate is recovered.

Hydrolysis occurs throughout the upper region of the vessel by the introduction of steam, acid and/or water in a concurrent flow in the upper region. In the lower region of the vessel, the cellulosic material is cooked and wash and is subsequently discharged as pulp from the vessel.

BRIEF DESCRIPTION OF THE INVENTION

A novel hydrolysis system has been developed for a pulping system. The hydrolysis and digesting of cellulosic material, e.g., wood chips, is performed in a single pressurized reactor vessel. The cellulosic material undergoes hydrolysis in an upper zone of the vessel. The hydrolysis takes place in the vessel at the vessel in the conditions of pH of 1 to 6, preferably 3 to 4, and at temperatures in a range of 150° C. to about 170° C., and preferably in a range of 160° C. to 170° C. Hydrolysate and liquids are removed from the reactor through an upper extraction screen in the vessel. A wash zone of the vessel is below the upper extraction screen and above the cooking zones of the vessel. Wash liquid flows upward through the wash zone and to an extraction screen. Wash liquid is also extracted from the vessel through a wash liquid extraction screen at the bottom of the wash zone.

The cool wash liquid reduces the temperature of the cellulosic material flowing through the wash zone to suppress the hydrolysis reactions of the cellulosic material. Substantially all of the hydrolysis reactions are suppressed in the wash zone and much of the hydrosate is removed with the wash liquid and liquor flowing through the upper extraction screen at the top of the wash zone and from an extraction screen(s) at the bottom of the wash zone (s). Multiple wash zones below the upper extraction screen and above the cooking zones may be used to flush hydrolysate from the cellulosic material and ensure that hydrolysis has stopped prior to the cooking zones.

A chemical, such as in an amount of 0.01 percent (%) to 5%, preferably 0.1 percent to 1 percent, of the wood in the slurry in the vessel may be included in the wash liquid added to the wash zone. The wash water or wash liquid (if chemical has been added) suppresses hydrolysis reactions in the cellulosic material below the extraction screen. This wash liquid has a temperature in a range of 10° C. to 70° C. cooler than the hydrolysis temperature, and preferably 20° C. to 50° C. cooler, and most preferably 25° C. to 35° C. cooler. Further, the wash liquid preferably has a pH in a range of 3 to 7, and most preferably in a pH range of 4 to 5. Chemicals, such as sodium hydroxide (NaOH), essentially sulfur free white liquor or a mixture of these chemicals, may be added to the wash liquid. The chemical(s) are added to the wash water to suppress hydrolysis and remove hydrosate, and optionally to adjust the pH of the wash liquid. The addition of the chemicals to the wash water results in substantially more hydrolysate being extracted from the cellulosic material flowing through the wash zone, that would occur if the wash liquid was purely water.

Chemical digesting of cellulosic material is performed below the hydrolysis and wash zones. Cooking chemicals are introduced into the vessel to cooking zones in the vessel and below the wash zones. Pulp generated from cooking the cellulosic material is discharged from the bottom of the vessel.

The process disclosed herein reduces the risk of precipitation of lignin and other dissolved wood components by delaying the introduction of alkali until after hydrolysis has been accomplished. The process may also reduce alkali consumption during chemical digesting of cellulosic material.

A reaction vessel has been developed including: a material input receiving cellulosic material and a material discharge for the cellulosic material, wherein the cellulosic material flows through the reaction vessel from the material input to the material discharge; a hydrolysate and liquid extraction screen; a hydrolysis zone between the material input and the hydrolysate and liquid extraction screen, wherein the hydrolysis zone is maintained at or above at a hydrolysis temperature at which a hydrolysis reaction occurs in the cellulosic material; a wash zone between the hydrolysate and liquid extraction screen and a wash liquid extraction screen and a wash liquid extraction screen in which the hydrolysis is substantially suppressed; a wash liquid inlet port for introducing a wash liquid into the wash zone, wherein at least a portion of the wash liquid entering the wash liquid inlet port flows through the wash zone to the hydrolysate and liquid extraction screen, and wherein the wash liquid is introduced to the wash zone at a temperature below the hydrolysis temperature and the wash liquid suppresses the hydrolysis in the second vessel zone; a cooking zone below the wash zone, wherein said cooking zone includes a cooking liquor injection port; a cooking liquor extraction screen below the cooking zone, and a pulp discharge below the cooking liquor extraction screen for discharging digested cellulosic material.

A reaction vessel has been developed comprising: a material input receiving cellulosic material and a material discharge for the cellulosic material, wherein the cellulosic material flows through the reaction vessel from the material input to the material discharge; a steam inlet receiving steam to heat and pressurize the cellulosic material in the vessel; a hydrolysate and liquid extraction screen; a hydrolysis zone below the material input and above the hydrolysate and liquid extraction screen, wherein the hydrolysis zone is maintained at or above a hydrolysis temperature at which a hydrolysis reaction occurs in the cellulosic material; a cooling zone below the hydrolysate and liquid extraction screen and above a cooling liquid extraction screen, wherein the cooling zone is maintained at a temperature below the hydrolysis temperature; a water inlet port for introducing water into the cooling zone, wherein at least a portion of the water entering the cooling inlet port flows through the cooling zone upward to and is extracted by the hydrolysate and liquid extraction screen, and wherein the water is introduced to the cooling zone at a temperature below the hydrolysis temperature; a first liquid extraction screen below the cooling zone and above a cooking zone; the cooking zone includes a cooking liquor injection port, and a cooking liquor extraction screen at or below the cooking zone and above the material discharge.

A method has been developed to produce pulp from cellulosic material comprising: introducing cellulosic material to an upper inlet of a pressurized reaction vessel; adding pressure and heat energy to the vessel; hydrolyzing the cellulosic material in an hydrolysis zone of the reaction vessel; extracting hydrolysate and liquid from the cellulosic material through a hydrolysate and liquid extraction screen below the hydrolysis zone and above a cooling zone of the vessel; introducing a cooling liquid to the cooling zone, wherein the cooling liquid suppresses hydrolysis of the cellulosic material in the cooling zone and wherein at least a portion of the cooling liquid flows upward through the cellulosic material to and is extracted by the extraction screen; digesting the cellulosic material in a cooking zone below the cooling zone by injecting a cooking liquor in the cooking zone, and discharging the digested cellulosic mater from a discharge port of the vessel wherein the port is below the cooking zone.

BRIEF DESCRIPTION OF THE DRAWING

FIG. 1 is a schematic diagram of a continuous pulping vessel which performs hydrolysis and digesting of cellulosic material.

DETAILED DESCRIPTION OF THE INVENTION

FIG. 1 shows a single vessel 10 for a steam phase hydrolysis and digesting system. The vessel may be a cylindrical reactor vessel arranged vertically and may be over 100 feet tall. The vessel may be pressurized to a pressure above atmospheric pressure. The vessel may be a component of a pulp processing plant.

The vessel 10 includes an internal top separator 12. A slurry of cellulosic material is conveyed to the top separator via pipe 14 from a conventional chip feed system 16. A screw conveyor in the separator 12 discharges the slurry of cellulosic material into an upper zone of the vessel. The top separator also extracts liquid from the slurry. The extracted liquid is discharged from the vessel via pipe 13 and may be recirculated to the chip feed system.

Cellulosic material and the liquid remaining in the slurry are discharged from the top separator 12 and fall through a gas phase 20 in an upper elevation of the vessel. The discharged cellulosic material falls through the gas phase and to the top of the chip level 22 in the vessel, if the vessel is a vapor phase vessel. If the vessel is a hydraulic vessel, the discharged material from the top separator directly enters a slurry that fills the vessel.

As new cellulosic material falls from the separator, material already at or below the chip level 22 is forced further down into the vessel. The liquor level 24 in the vessel may be at or near the chip level. Preferably, the liquid level is such that the top of the chip solids in the cellulosic material, generally represented by the top of the chip level 22, is entirely submerged below the liquid level 24.

Steam or other pressurized fluid 17 at above atmospheric pressure is introduced via pipe 18 to the gas phase zone 20 at the top of the vessel to provide heat and pressure to the vessel. Steam is preferably the principal external source of heat energy to the vessel. The vessel may be controlled based on pressure provided by the steam (or an inert gas) introduced to the top of the vessel. The use of a vapor or steam phase vessel 10 should reduce operating problems associated with gas formation by hydrolysis that may occur in the top of the vessel. However, a hydraulic vessel may still benefit from the introduction of wash liquid in an upper wash zone as is disclosed herein.

Hydrolysis occurs below the liquid surface level 24 and in an upper zone (A) of the vessel. The upper zone (A) extends generally from the liquid surface level 24 to the first (upper) extraction screen(s) 26. The upper zone (A) is maintained at conditions that promote hydrolysis, such as being maintained at a temperature of at least 150 degrees Celsius or preferably at least 170 degrees Celsius. However, the temperature promoting hydrolysis may be below 150 to 170 degrees Celsius if chemicals, e.g., by adding an acidic solution to the liquor in the upper zone (A). Hydrolysate is generated in the upper zone A and is removed by the first extraction screen (or screen set) 26.

Dissolved lignin in the upper zone (A) is not desired as the dissolve lignin may flow with the wash water through the through screen 26. Lignin which has been dissolved under alkaline conditions, e.g., pH greater than 11, tends to precipitate at pH levels lower than a pH of 11. Preferably the pH of the upper zone (A) is below 11 and the upper zone is maintained at conditions that do not cause substantial amounts of lignin to dissolve in that zone.

The extracted liquid from screen 26 passes through a pipe 28 and to a flash tank 30. Steam 31 generated in the flash tank may be used as heat energy in the pulp plant, such as to heat the upper zone of the vessel. The liquid from the flash tank may be recirculated via pipe 130 to the chip feed system to transport the slurry of cellulosic material to the vessel 10 and/or recovered, such as to extract sugars from the hydrolysate.

A wash zone (B) in the vessel is between the first extraction screen 26 and a wash liquid extraction screen 33. Wash liquid 36 is supplied to the wash zone B to, in part, suppress hydrolysis in zone B. In wash zone B, counter-current washing occurs of the chip material moving downward through the vessel. The flow of material through the vessel is generally down and a counter-current flow of liquid is generally up. The general counter-flow direction of the wash liquid, e.g., wash water alone or with chemicals, in zone B is upward (see up arrow in zone B) and the general flow direction of the cellulosic materials is downward (see down arrow in zone B) through the vessel.

The wash liquid, e.g., either simply water or a mixture of water and chemicals, preferably has a temperature of 10° C. to 70° C. cooler than the hydrolysis temperature, more preferably 20° C. to 50° C. cooler, and most preferably 25° C. to 35° C. cooler. The pH of the wash liquid is preferably 3 to 7, and more preferably 4 to 5. The wash liquid is supplied to upper elevations of the vessel, such as zone B, from a wash liquid source 36 and by recirculating liquor extracted from the wash extraction screen 33. The wash liquid and the recirculating liquor are sufficient to create an upward flow of fluids through zone B to the upper extraction screen 26. Preferably, most of the washing of the cellulosic material occurs in zone B.

The wash liquid in source 36 may be simply wash water or a combination of wash water and chemicals such as one or more of sodium hydroxide (NaOH) and essentially sulfur free white liquor. Preferably, essentially sulfur free white liquor has no more than 0.10 parts per million (ppm) of sulfur compounds. For example, the amount of chemicals added to the wash water may be 0.01% to 5%, preferably 0.1% to 1%, of the amount of cellulosic material, e.g., wood, in the slurry flowing through the vessel. The chemicals are provided from a chemical source 53 and flow through pipe 57 to mix with wash water 34 in the source of wash liquid 36. The mixture 36 of wash liquid and chemicals (if any) flow through wash liquid pipe 59 and mix with a recirculation flow of extracted liquor flowing through wash liquid extraction pipe 37 and back into the wash zone B through wash liquid inlet port 61.

As the wash liquid flows upward through zone B to the upper extraction screen 26, the wash liquid mixes with the cellulosic material flowing down through zone B to the upper extraction screen 26. The wash liquid tends to cool the material and flush acids and other compounds from the materials. The acids and other compounds flow out through the extraction screen 26. The cooling and flushing of the cellulosic material tends to suppress and preferably stop hydrolysis reactions occurring in the cellulosic material.

Con-current washing may occur below the second screen 33 as the cellulosic material flows downward (see arrow in zone C) to a third extraction screen 38. In zone C, fluid flows generally downward con-currently, e.g., in the same flow direction, with the cellulosic material. Zone C is a wash and buffer zone that removes any remaining hydrolysate from the cellulosic material. The remaining hydrolysate is extracted in fluid passing through the extraction screen 38 and flows through pipe 40 to a flash tank 42. As with flash tank 30, steam from the flash tank 42 may be recovered as heat energy, e.g., introduced to the top of the vessel 10, and liquid from the tank 42 may be recirculated to the chip feed system and recovered for other purposes, such as the recovery of sugars from the hydrolysate. Hydrolysate from screens 38 and 26 can be circulated via lines 19A and 19B to the to the top of the treatment vessel, if desired.

The hydrolysis cooling and wash zones (B and C) remove hydrolysate from the cellulosic material moving down through the vessel. Zones B and C buffer the cellulosic material undergoing hydrolysis in zone A from the cellulosic material undergoing digestion, e.g., cooking, in zones D and E. The wash zones are immediately below the hydrolysis zone (A) in the vessel. The wash liquid may be purposefully maintained at temperatures below hydrolysis temperature of the cellulosic material by adjusting the amount of wash liquid, which is cooler than the material in zone B, supplied to zone B and by adjusting the amount of cool water 34 supplied to the wash liquid 36. The wash liquid cools the slurry of cellulosic material and liquor in zone B to suppress hydrolysis and assists with the removal of hydrolysate from the cellulosic material by washing the hydrolysate form the cellulosic material and removing the hydrolysate as the wash liquid is extracted through screen 26.

Preferably, the temperature of the cellulosic material as it moves down from the buffer section (zone C) is below normal hydrolysis temperatures. The temperature of the cellulosic material is cooled by the cool wash liquid flowing into zones B, and optionally zone C, where the wash liquid is below the normal hydrolysis temperatures.

The wash liquid may also adjust the pH level of the material to be near or above neutral prior to the cooking zones (D and E). Removing hydrolysate and adjusting the pH level of the cellulosic material above the cooking zones generally should assist in minimizing or preventing precipitation of dissolved lignin present in the cooking chemicals in the cooking zones.

The wash liquid and liquor extraction and recirculation pipe 37 may include a pH monitor 44. The pH of the recirculating wash liquid and liquor extracted through screen 33 and to be returned to the vessel through pipe 37 is monitored 44. The amount of wash liquid 36 added to the recirculating wash liquid and liquor in pipe 37 may be determined, in part, to maintain the pH of the wash liquid and liquor flowing from line 37 to the vessel within a predetermined range such as between 4 pH and 10 pH, or in a narrower range of 6 pH to 10 pH or 6 pH to 8 pH. If the pH of the extracted wash liquid and liquor in pipe 37 is at a higher pH than the predetermined pH range, the amount of wash liquid 36 being added to pipe 37 may be increased. The pH of the wash liquid is typically at a pH of 7 and increasing the amount of wash liquid added to pipe 37 should reduce the pH of the liquid in pipe 37 towards a pH of 7. Further, an acid chemical, see chemical source 53, may be added to the recirculation pipe 37 to assist in pH control of the wash liquid and liquor flowing through the pipe to the vessel. If the pH of the extracted wash liquid and liquor in pipe 37 is at the low end or below the predetermined pH range, chemicals from source 53 having a high pH may be added to the wash liquid 36 to be introduced to the flow in pipe 37.

The diameter of the vessel 10 in the hydrolysis and washing sections (zones A to C) may be relatively uniform. Similarly, the diameter of the vessel in the cooking zones (zones D to F) may be relatively uniform and may be uniform with respect to zones A to C. Alternatively, one or more of the zones, e.g., D to F, may have a larger diameter than zones at higher elevations.

Cooking of the cellulosic material occurs in zones D and E that are below the wash and buffer zones (A to C) of the vessel. Cooking is chemically treating the cellulosic materials to dissolve lignins from the cellulosic material. Cooking chemicals are preferably not introduced to the top of the vessel 10 and preferably not above the third extraction screen 38.

The cooking zones (D to E, and optionally F) are below the washing and buffer zones (B and C). In the cooking zones, cooking chemicals are injected to provide quick and thorough penetration of cooking chemicals into the cellulosic material. The cooking zones may be arranged such that the upper cooking zone (D) operates at a reduced temperature as compared to lower cooking zone(s) (E and F). The cooking zones may include con-current and counter-current liquor flow. Cooking zones D and F are shown with a counter-current liquor flow, and zone E is shown with con-current liquor flow.

Cooking chemicals (liquor) 50 are introduced to the vessel preferably in zone D. A cooking liquor recirculation pipe 52 recovers black liquor from an extraction screen 54 immediately below zone D. Additional cooking liquor 50, e.g., white liquor, is mixed with the cooking liquor being recirculated and introduced into zone D from pipe 52. The cooking liquor may be heated to cause the cellulosic material to begin cooking. The cooking process may begin as the cooking liquor is introduced the cooking zones, e.g., zone D. Additional cooking liquor may be removed at one or more extraction screens 58 at various elevations of zones E and F. The temperature of the cellulosic material may remain relatively constant as the material moves through zones E and F to the pulp discharge 56 at the bottom 32 of the vessel.

Cooking in the vessel may be with multiple stages where the cellulosic material passing through the first stage (upper elevation-zone D) is at a lower temperature than the cellulosic material at other stages (lower elevations-zones E and F). An optional cooking operation includes cooking of the cellulosic material as the material is introduced to the cooking liquor. Yet another cooking operation may include cooking the cellulosic material, once introduced to the cooking liquor, at different temperatures as the cooking process proceeds, e.g., zone D is a temperature higher than zones E and F.

Zone F may be a final cooking zone or a wash zone. Wash water, from a wash water source 34, is introduced to the bottom 32 of the vessel and flows upward through the lowermost zone F from a source 34 of wash water. In the final wash zone, e.g., zone F, the wash water removes cooking chemicals from the cellulosic material just prior to discharge of the cellulosic material from the treatment or digester vessel.

Heat recovery methods may be continuously used to recover heat energy discharged by the flash tanks and the extraction screens 26, 33. For example if heat can be recovered from the circulation streams such as from wash liquid and liquor extraction and recirculation pipe 37, such recovery could involve the use of heat exchangers or the like. It may also be necessary to pre-heat liquid 18 injected to the top of the vessel. This pre-heating could be accomplished via use of hot streams extracted from the vessel in heat exchange contact with the circulation pipes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method to produce pulp from cellulosic material comprising:

introducing cellulosic material to an upper inlet of a pressurized reaction vessel;

adding pressure and heat energy to the vessel;

hydrolyzing the cellulosic material in a hydrolysis zone of the reaction vessel, wherein a temperature in the hydrolysis zone is at least 150 degrees Celsius;

extracting hydrolysate and liquid from the cellulosic material through a hydrolysate and liquid extraction screen below the hydrolysis zone and above a cooling zone of the vessel;

introducing a cooling liquid to the cooling zone, wherein the cooling liquid suppresses hydrolysis of the cellulosic material in the cooling zone and the cooling liquid is essentially sulfur free, and wherein at least a portion of the cooling liquid flows upward through the cellulosic material to and is extracted by the extraction screen;

digesting the cellulosic material in a cooking zone below the cooling zone by injecting a cooking liquor in the cooking zone, wherein the cooking liquor includes sulfur containing chemicals and the cooking liquid is not introduced into the vessel in the hydrolysis zone or the cooling zone;

discharging the digested cellulosic mater from a discharge port of the vessel wherein the port is below the cooking zone, and wherein the cooling liquid is a mixture of water and at least one of sodium hydroxide and essentially sulfur free white liquor.

2. The method as in claim 1 wherein the amount of at least one of sodium hydroxide and essentially sulfur free white liquor in the cooling liquid is in a range of 0.01 percent to 5 percent of cellulosic material in the vessel.

3. The method as in claim 1 wherein a pH in the hydrolysis zone is in a range of 1 to 6.

4. The method of claim 1 wherein the cellulosic material in the hydrolysis zone is maintained at a temperature above a hydrolysis temperature and the cellulosic material in the cooling zone is maintained at a temperature at least ten degrees Celsius below the hydrolysis temperature.

5. The method of claim 4 wherein the hydrolysis temperature is in a range of 150° C. to 170 degrees Celsius.

6. The method of claim 4 wherein the cooling liquid when introduced to the cooling zone is 10° C. to 70° C. cooler than the hydrolysis temperature.

7. The method of claim 1 further comprising extracting liquid from a liquid extraction screen at or below the cooling zone, adding a cooling liquid to the extracted liquid and injecting the extracted liquid and the added cooling liquid to the cooling zone, wherein the added cooling liquid is at a temperature below the hydrolysis temperature.

8. The method of claim 7 further comprising monitoring the pH of the extracted liquid and increasing a flow of the cooling liquid introduced to the cooling zone if the monitored pH exceeds a predetermined pH level.

9. The method of claim 1 further comprising flashing the hydrolysate and liquid extracted through the hydrolysate and liquid extraction screen, and injecting into the vessel steam recovered from the flashed hydrolysate and liquid, and separating hydrolysate from the flashed hydrolysate and liquid.

* * * * *